United States Patent [19]

Kato

[11] Patent Number: 4,942,276

[45] Date of Patent: Jul. 17, 1990

[54] CLICKED KEY BOARD SWITCH

[75] Inventor: Hideo Kato, Mobara, Japan

[73] Assignee: Futaba Denshi Kogyo Kabushiki Kaisha, Mobara, Japan

[21] Appl. No.: 336,057

[22] Filed: Apr. 11, 1989

[30] Foreign Application Priority Data

Apr. 11, 1988 [JP] Japan ..... 63-47774[U]

[51] Int. Cl.[5] ..... H01H 1/10

[52] U.S. Cl. ..... 200/517; 200/341; 200/332

[58] Field of Search ..... 200/517, 341, 345, 332; 400/479

[56] References Cited

U.S. PATENT DOCUMENTS

| | | | |
|---|---|---|---|
| 3,909,564 | 9/1975 | Scheingold et al. | 400/479 |
| 3,982,081 | 9/1976 | Demler, Jr. | 200/517 |
| 4,486,637 | 12/1984 | Chu | 200/517 |
| 4,553,009 | 11/1985 | Van Zeeland | 200/342 |
| 4,800,245 | 1/1989 | Murmann et al. | 200/345 |
| 4,831,223 | 5/1989 | Wako | 200/517 |

FOREIGN PATENT DOCUMENTS

| | | | |
|---|---|---|---|
| 2475286 | 1/1980 | France | 200/341 |

*Primary Examiner*—Henry J. Recla
*Assistant Examiner*—Keith Kupferschmid
*Attorney, Agent, or Firm*—Oblon, Spivak, McClelland, Maier & Neustadt

[57] ABSTRACT

A clicked key board switch capable of minimizing an error or deviation between a position at which click feeling is produced and a position at which the switch is turned on while reducing the number of parts. In the switch, when a key stem slidably arranged in a frame is pushed down, a membrane switch is forcedly operated through a pressing element provided in the frame. The pressing element includes a base fixed at an upper end thereof on the side of the frame and provided thereon a projection engaged with the key stem when it is pushed down and a pressing section connected to the base so as to extend from the base to a position above the membrane switch and forcedly operating the membrane switch when the base is laterally forced by the key stem.

7 Claims, 5 Drawing Sheets

CLICKED KEY BOARD SWITCH

BACKGROUND OF THE INVENTION

1. Field of the Invention

This invention relates to a key board switch exhibiting click feeling (hereinafter referred to as "clicked key board switch") which is used for a key board or the like and adapted to operate a membrane switch arranged on a patch in a frame due to vertical movement of a key stem provided in the frame, and more particularly to a clicked key board switch constructed so as to reduce deviation between a position at which click feeling is provided and a position at which the switch is turned on.

2. Description of the Prior Art

A key board switch which has been conventionally used for a key board or the like is generally constructed in a manner such that a key stem is vertically movably supported in a frame in which a membrane switch is arranged, resulting in the membrane switch in the frame being operated due to vertical movement of the key stem, as disclosed in, for example, Japanese Utility Model Application Laying-Open Publication No. 168028/1983, Japanese Utility Model Application Laying-Open Publication No. 165623/1987 and Japanese Patent Application Laying-Open Publication No. 80927/1987. In the so-constructed conventional key board switch, a pressing portion which is contacted directly with the membrane switch to operate it generally comprises a separately formed member interposed between the membrane switch and the key stem as disclosed in the Japanese publications mentioned above. Alternatively, it may be integrally formed at a lower portion of the key stem as disclosed in Japanese Utility Model Application Laying-Open Publication No. 133927/1986. Also, the conventional key board switch is often provided with a mechanism for providing a finger of an operator with click feeling in addition to the above-described mechanism for operating the membrane switch, as disclosed in Japanese Utility Model Application Laying-Open Publication No. 193634/1985.

The conventional key board switch in which the mechanism for pushing down the membrane switch is provided separate from the mechanism for providing click feeling has a disadvantage of generating considerable deviation between a position at which the membrane switch is turned on and a position at which click feeling is provided because both mechanisms are separately arranged.

Also, in the conventional key board switch in which the pressing portion is integrally formed at the lower portion of the key stem, the key stem is formed into a shape that its lower side is larger than its top side. This results in an arrangement of the key stem in the frame which requires the insertion of the key stem into the frame from the side of a lower surface of the frame. Accordingly, such construction is not suitable for the automatic assembling of the key board switch, resulting in failing to be accommodated to such a free key layout as employed in a register.

SUMMARY OF THE INVENTION

The present invention has been made in view of the foregoing disadvantage of the prior art.

It is an object of the present invention to provide a clicked key board switch which is capable of minimizing an error or deviation between a position at which click feeling is produced and a position at which the switch is turned on while reducing the number of parts.

In accordance with the present invention, a clicked key board switch is provided. The clicked key board switch comprises a frame, a key stem arranged in the frame so as to be movable in the frame, a pressing element arranged in the frame and a membrane switch arranged in a manner to be forcedly operated by the pressing element when the key stem is pushed down. The pressing element comprises a base fixed at an upper end thereof on the side of the frame and provided thereon a projection engaged with the key stem when it is pushed down and a pressing section connected to the base so as to extend from the base to a position above the membrane switch and forcedly operating the membrane switch when the base is laterally forced by the key stem.

In the clicked key board switch of the present invention constructed as described above, when the key stem is pushed down, it is engaged with the projection provided on the base of the pressing element which is fixed at its upper end on the side of the frame. When the key stem is further pressed down by force of a predetermined magnitude to force the projection of the base, resulting in the base being laterally moved, the operating section of the pressing element is downwardly moved to close the membrane switch. Concurrently, the force is also added to the force for operating the key stem, resulting in providing a finger of an operator with a click feeling.

BRIEF DESCRIPTION

These and other objects and many of the attendant advantages of the present invention will be readily appreciated as the same becomes better understood by reference to the following detailed description when considered in connection with the accompanying drawings in which like reference numerals designate like or corresponding parts; wherein:

FIG. 1(*b*) is a vertical sectional view of the clicked key board switch shown in FIG. 1(*a*) taken in a direction perpendicular to FIG. 1(*a*);

FIG. 1(*c*) is a sectional view showing an essential part of the clicked key board switch shown in FIG. 1(*a*) wherein a key stem is moved to a lowermost position;

DETAILED DESCRIPTION OF THE PREFERRED EMBODIMENT

Now, a clicked key board switch according to the present invention will be described hereinafter with reference to the accompanying drawings.

Figure 1:
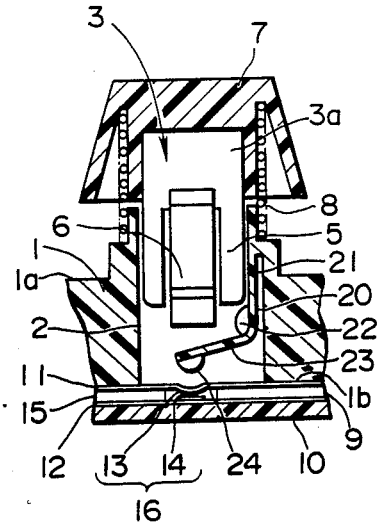
FIG. 1(*a*) is a vertical sectional view showing an embodiment of a clicked key board switch according to the present invention.
Figure 1:
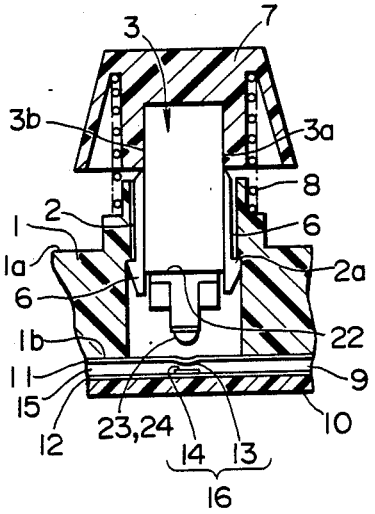
Figure 1:
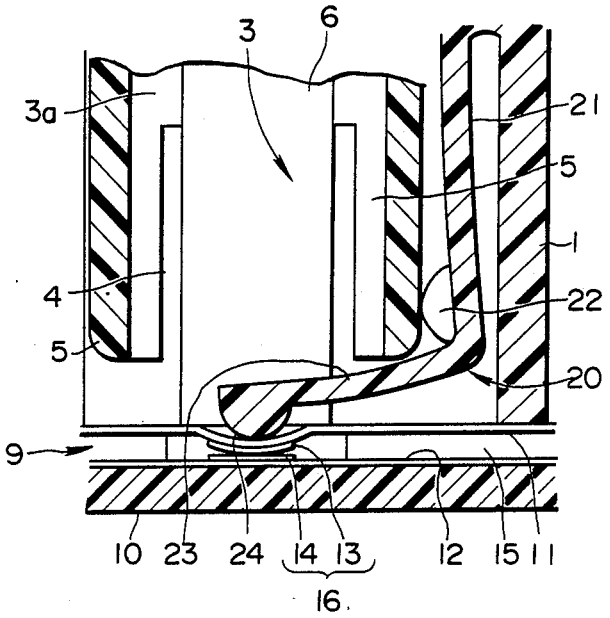
Figure 2:
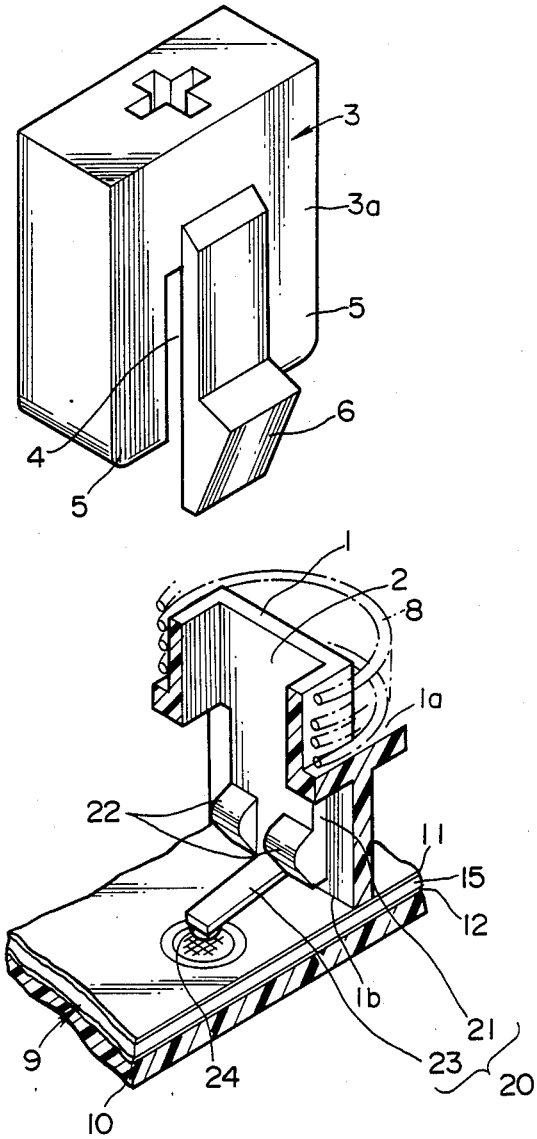
FIG. 2 is an exploded perspective view of the clicked key board switch shown in FIG. 1(*a*)

FIGS. 1(*a*) to 3(*b*) show an embodiment of a clicked key board switch according to the present invention.

A clicked key board switch of the illustrated embodiment includes a frame 1 which serves as a casing for a key board or the like. The frame 1 is formed with an aperture 2, which, in the illustrated embodiment, is formed into a rectangular shape. In the aperture 2 is arranged a key stem 3 so as to be vertically movable or slidable therein, which is inserted from the side of an upper surface 1*a* of the frame 1 into the aperture 2. The key stem 3 comprises a columnar member which may be formed into a rectangular configuration so as to substantially correspond to the shape of the aperture 2. In the illustrated embodiment, the key stem 3 is formed at a lower half thereof into a bifurcated shape by two side walls 5 opposite to each other with a central recess 4 being interposed therebetween. The recess 4 is opened at a lower portion of each of both side surfaces 3*a* and 3*b* of the key stem 3 perpendicular to the side walls 5. At least one of the two side walls 5 which is engaged with a pressing element 20 described hereinafter is required to have rigidity. Also, the side wall 5 is formed into a bifurcated shape so as to correspond to a click projection 22 of the pressing element 20. Further, the side surfaces 3*a* and 3*b* of the key stem 3 to which the recess 4 is opened each have a stem guide 6 fixed on an upper portion thereof so as to downwardly extend therefrom. The stem guides 6 each comprise a plate-like member formed of a material which permits it to be deflected toward the recess 4. Each stem guide 6 is formed at a lower end portion thereof into a wedge-like shape. Such construction and configuration of the key stem 3 permits the key stem 3 to be inserted in the frame from the side of the upper surface 1*a* of the frame 1 while deflecting the stem guides 6 toward the recess 4. Also, each of the inner surfaces of the frame 1 defining the aperture 2 therebetween and facing in a direction perpendicular to the side walls 5 of the key stem 3, as shown in FIG. 1(*b*), is formed with a step 2*a* which is adapted to engagedly hold the wedge-shaped lower end portion of the each of the stem guides 6, resulting in preventing upward disengagement of the key stem 3 from the aperture 2. This causes the key stem 3 to be vertically movable in a portion of the frame 1 below the steps 2*a* in safety while being guided by the aperture 2 and stem guides 6. In addition, the clicked key board switch includes a key top 7 mounted on an upper end portion of the key stem 3 projecting from the upper surface 1*a* of the frame 1. Between the key top 7 and the upper surface 1*a* of the frame 1 is interposedly arranged a return spring 8, which constantly upwardly forces the key top 7 to normally hold the key stem 3 at its original position as shown in FIGS. 1(*a*) and 1(*b*).

On a lower surface 1*b* of the frame 1 is mounted a membrane switch 9 serving as contact means in a manner to be interposed between a substrate 10 and the frame 1. The membrane switch 9 includes two films 11 and 12 having an upper contact element 13 and a lower contact element 14 respectively printed thereon so as to be opposite to each other through a spacer 15, resulting in constituting a contact 16.

The clicked key board switch of the illustrated embodiment further includes the pressing element 20 for selectively contactedly forcing the membrane switch 9 in a downward direction, which is formed separate from the key stem 3 and is integrally arranged on the side of the frame 1. More particularly, the pressing element 20, as shown in FIGS. 1(*a*) and 2, is formed into a substantially L-shape and integrally mounted on one of the inner surfaces of the frame 1 defining the aperture 2 and opposite to one of the side walls 5 of the key stem 3. The pressing element 20 includes a base 21 constituting an upper section of the pressing element 20. In the illustrated embodiment, the base 21 comprises a flexible member like a leaf spring of which an upper end is integrally mounted on the frame 1 in a manner like a cantilever beam and which extends downwardly.

The pressing element 20 also includes a click projection 22 arranged on an inner surface of a lower end of the base 21, which is adapted to be engaged with the side wall 5 of the key stem 3 when the key stem 3 is downwardly pushed. Such construction of the pressing element 20 permits the side wall 5 of the key stem 3 to laterally force the click projection 22 when the key stem 3 is pushed down by force of a predetermined magnitude, resulting in the flexible base 21 being outwardly deflected.

Further, the pressing element 20 includes an elastic arm-like operating section 23 arranged on a lower end of the base 21 so as to substantially horizontally extend, so that the whole pressing element 20 is formed into a substantially L-shape as shown in FIGS. 1(*a*) and 1(*c*). The operating section 23 is formed on a lower surface of a distal end thereof with a pressing projection 24 of a hemispherical shape, which is adapted to be positioned above the contact 16 of the membrane switch 9.

In the illustrated embodiment, suitable determination of dimensions, configuration and arrangement of the pressing element 20 permit the pressing projection 24 to contact with the membrane switch 9 to downwardly force it when the side wall 5 of the key stem 3 is downwardly moved to push the click projection 22 laterally.

Now, the manner of operation of the clicked key board switch of the illustrated embodiment constructed as described above will be described hereinafter.

In FIGS. 1(*a*) and 1(*b*), the key stem 3 is moved to an uppermost position. When the key top 7 is pushed down to downwardly move the key stem 3, one of the walls 5 of the key stem 3 is engaged with the click projection 22 provided on the base 21 of the pressing element 20. When the key stem 3 is further pushed down by force of a predetermined level, the wall 5 laterally pushes the click projection 22, because the wall 5 has rigidity and the base 21 of the pressing element 20 has elasticity. This causes the base 21 of the pressing element 20 to be deflected in a right direction in FIGS. 1(*a*) and 1(*c*), resulting in the element 20 being pivotally moved in a counterclockwise direction about the upper end of the base 21 integrally fixed on the frame 1. This leads to downward movement of the operating section 23 formed integral with the base 21. Thus, as shown in FIG. 1(*c*), the pressing projection 24 downwardly forces the membrane switch 9 to close the contact 16. At this time, when the side wall 5 of the key stem 3 forces the click projection 22, the key stem 3 is applied thereto the above-described force for pressing the projection 22 in addition to force for pressing the return spring 8, so that the spring pressing force may be highly increased to provide a finger of an operator with click feeling.

Then, when the key top 7 is released from the pushing-down operation by the finger, the return spring 8 upwardly forces the key stem 3 to return it to the original position. This results in the pressing element 20 being returned to the original configuration and the contact 16 of the membrane switch 9 being open.

Figure 3:
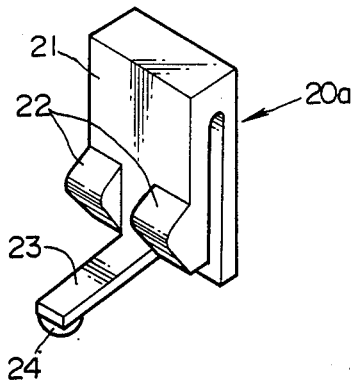
FIGS. 3(*a*) to 3(*e*) each are a perspective view showing a modification of a pressing element.
Figure 3:
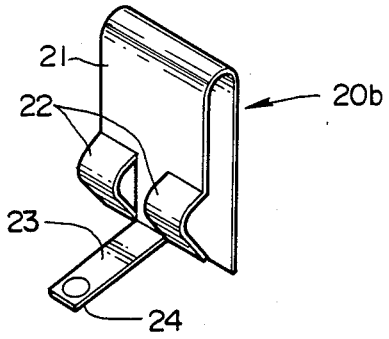
Figure 3C:
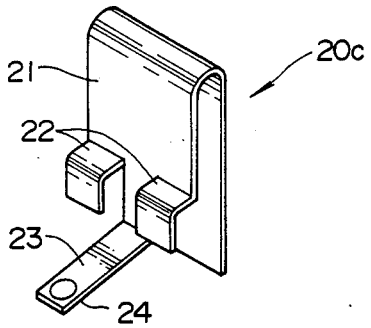
Figure 3D:
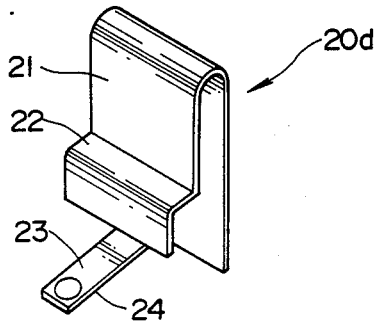
Figure 3E:
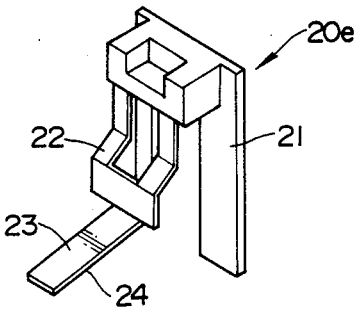

In the embodiment described above, the pressing element 20 is formed integral with the frame 1. However, the pressing element 20 may be formed separate from the frame 1, which is then mounted on the frame 1. FIGS. 3(*a*) and 3(*b–e*) show pressing elements 20*a* and 20(*b–e*) made by molding of a synthetic resin material and pressing of a metal sheet, respectively, which are formed separate from the frame 1. It is a matter of course that such separately-formed pressing elements 20*a* and 20*b* likewise exhibit the substantially same function and advantage as the above-described pressing element 20 formed integral with the frame 1.

Also, in the embodiment described above, the membrane switch 9 is used for the contact means, however, the key board switch of the present invention may be likewise applied to various contact means constructed in any different manner. Also, the present invention is effectively applicable to both key board switches of the frame-integral type and monolithic type.

As can be seen from the foregoing, the clicked key board switch of the present invention is so constructed that the pressing element arranged on the side of the frame exhibits click feeling. Such construction of the present invention minimizes deviation between a position at which the contact is closed and a position at which click feeling is exhibited. Also, it permits the single element to exhibit both functions or a mechanism for forcing the contact and a mechanism for providing click feeling, to thereby decrease the number of parts and simplify assembling of the switch. Further, it permits the key stem to be inserted from the side of the upper surface of the frame into the frame, resulting in assembling of the switch being facilitated, so that the switch of the present invention may be readily accommodated to such a free key layout as employed in a register.

While a preferred embodiment of the present invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the United States is:

1. A key board switch comprising:

a substrate;

a membrane switch arranged on said substrate;

a frame having a vertically extending aperture, said frame being arranged on said substrate interposing said membrane switch therebetween;

a key stem arranged in said aperture of said frame so as to be vertically movable within said aperture between an upper and lower position; and a pressing member of said membrane switch provided on said frame, said pressing member being substantially L-shape and extending downwardly from within an upper portion of said aperture in a cantilever fashion, said pressing member having a distal end positioned above said membrane switch and being provided with a projection to be engaged with said key stem when said key stem is pushed down to said lower position to make said membrane switch contact, said key stem being disengaged from said projection when said key is in said upper position.

2. The key board switch as defined in claim 1, wherein said pressing member is formed integral with said frame.

3. The key board switch as defined in claim 1, wherein said pressing member is formed separate from said frame and is fixed to said frame.

4. The key board switch as defined in claim 1, wherein said distal end of said pressing member is provided with a further projection to make said membrane switch contact.

5. The key board switch as defined in claim 1, wherein said key stem includes two side walls opposite to each other with a central recess interposed therebetween, one of said side walls being rigid and engaging with said projection of said pressing member.

6. The key board switch as defined in claim 5, wherein said key stem includes stem guides extending downwardly from both side surfaces of said key stem to which said recess is opened, said stem guides being formed in the shape of a wedge at a distal end thereof so as to permit said key stem to be inserted into said aperture, while deflecting said stem guides toward said recess.

7. The key board switch as defined in claim 6, wherein said frame is formed with a step in an upper portion of said aperture with which said distal end of stem is engaged.

* * * * *